United States Patent [19]

Mendenhall

[11] 4,034,968

[45] July 12, 1977

[54] ASPHALT MIXING APPARATUS

[76] Inventor: Robert L. Mendenhall, 1770 Industrial Road, Las Vegas, Nev. 89102

[21] Appl. No.: 601,177

[22] Filed: Aug. 1, 1975

Related U.S. Application Data

[63] Continuation-in-part of Ser. No. 487,927, July 12, 1974, abandoned, Ser. No. 487,928, July 12, 1974, abandoned, and Ser. No. 488,518, July 15, 1974, Pat. No. 4,000,000.

[51] Int. Cl.[2] ..... E01C 19/10

[52] U.S. Cl. ..... 259/158; 259/3; 259/161

[58] Field of Search ..... 259/3, 14, 30, 89, 90, 259/150, 157, 158, 161, 164, 169; 34/131, 140, 141

[56] References Cited

U.S. PATENT DOCUMENTS

| | | | |
|---|---|---|---|
| 35,469 | 6/1862 | Rand et al. | 259/90 |
| 466,882 | 1/1892 | Shettle | 259/30 |
| 2,715,517 | 8/1955 | Bojner | 259/158 |
| 2,923,538 | 2/1960 | Schoonover | 259/164 |
| 3,357,689 | 12/1967 | Arnesen et al. | 259/164 |
| 3,544,077 | 12/1970 | Van Elten | 259/3 |
| 3,614,071 | 10/1971 | Brock | 259/158 |
| 3,832,201 | 8/1974 | Shearer | 259/158 |
| 3,845,941 | 11/1974 | Mendenhall | 259/157 |
| 3,866,888 | 2/1975 | Dydzyk | 259/158 |

*Primary Examiner*—Richard E. Aegerter
*Assistant Examiner*—Richard R. Stearns
*Attorney, Agent, or Firm*—Jerry R. Seiler

[57] ABSTRACT

In a heating and mixing apparatus, particularly useful for asphalt-aggregate compositions and comprising an elongated drum having an interior cavity in which the composition is heated and mixed as the drum is rotated, an improvement comprises at least one and preferably a plurality of scoops secured exteriorly of the drum for picking up composition as the drum rotates and which composition is introduced gravitationally to the drum interior by a port communicating with the scoop. In another embodiment, at least one and preferably a plurality of ports are spaced along the drum exterior and communicating between the interior cavity and exterior of the drum and through which ports the heated and mixed composition is recovered. In still another embodiment at least one and preferably a plurality of ports communicating with the drum cavity and exterior are provided along the drum for venting water vapor removed from used asphalt-aggregate composition as it is heated to approximately the boiling point of water.

13 Claims, 5 Drawing Figures

ASPHALT MIXING APPARATUS

BACKGROUND OF THE INVENTION

This application is a continuation-in-part of my co-pending applications Ser. Nos. 487,927 and 487,928, filed July 12, 1974 both now abandoned and 488,518, now U.S. Pat. No. 4,000,000, filed July 15, 1974.

In my aforesaid co-pending applications there are described processes and apparatus for recycling used asphalt-aggregate compositions. The apparatus, of which the present invention constitutes an improvement, includes an elongated cylindrical drum having a plurality of heating tubes extending substantially along the length of the drum interior. Used asphalt-aggregate compositions are introduced into an input end of the drum as it is rotated while heating the tubes so that the composition becomes heated gradually and mixed as it contacts the heated tube surfaces. The drum is tilted so that the composition is drawn gravitationally from the input end to the output end. The description in my aforesaid applications of the apparatus and method of its use in producing recycled asphalt-aggregate compositions are incorporated herein by reference.

As described in my aforesaid co-pending applications, a hopper and chute type of apparatus is used to introduce the composition into the heating and mixing drum at the cool input end. The present invention is intended to utilize a different means for introducing compositions into the cool input drum end incorporating a self-loading feature whereby composition is introduced into the drum as it is rotated.

in my aforesaid co-pending applications Ser. Nos. 487,927, 487,928 and 488,518 as well as my U.S. Pat. No. 3,845,941, there have been described ways of removing and venting water vapor from the used asphalt-aggregate compositions which often have a significant amount of water or moisture therein. The presence of moisture in the material as it nears or approaches the hotter apparatus end increases the energy requirements to heat the composition to required output temperatures of 250°–300° F or so. This problem is compounded in the apparatus as the moisture boils off only to condense in the cooler drum end. Unless the water vapor is properly vented or exhausted during the heating process, the repeated condensation will affect the efficiency of the process. Accordingly, in another embodiment of this invention one or more ports intermediate the cool input and hot output ends of the mixing drum are provided for venting water vapor at or near the location at which the composition is heated to the water boiling point or temperature at which moisture within the composition is vaporized.

in my previous co-pending applications there is shown and described a chute member on the forward output end of the apparatus from which heated and mixed composition is drawn and recovered. It is still another embodiment of the invention to provide an improved means for recovering the composition at the forward end of the apparatus. Details of these improvements will be evident from the following detailed description.

SUMMARY OF THE INVENTION

The improved apparatus for loading or introducing composition to a rotating mixing drum according to the invention comprises at least one scoop secured to the drum exterior and extending outwardly therefrom at or adjacent the input drum end and a port through the drum exterior and communicating with the scoop and the drum interior. The scoop is used in combination with a trough or other receptacle in which composition is directed and into which the scoop is received as the drum rotates whereby the scoop picks up composition which is then introduced gravitationally into the drum interior.

In another embodiment, at least one port extends through the drum at or near the location at which composition in the drum is heated to or near the temperature at which moisture is vaporized and is vented directly through the port into the atmosphere. Preferably, a scoop member or similar device for picking up composition is secured near or adjacent the water vapor exhaust port on the drum exterior and which scoop cooperates with a through member adjacent thereto and exteriorly of the drum for picking up composition which falls through the exhaust port during drum rotation.

In still another embodiment, at least one and preferably a plurality of ports are spaced around the drum exterior, communicating with the drum interior at or near the hot forward output end of the apparatus and through which ports heated and mixed composition is recovered as it falls gravitationally through the ports during drum rotation.

DETAILED DESCRIPTION OF THE INVENTION

SCOOP FEED APPARATUS

Figure 1:
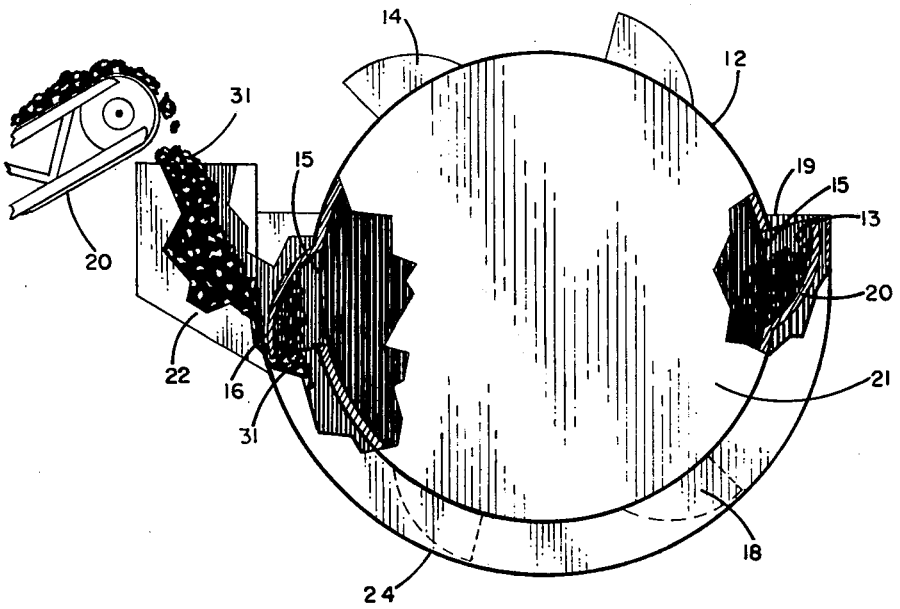
FIG. 1 is an end elevational view, partly cut away and in section showing a scoop feed embodiment of the invention.
Figure 2:
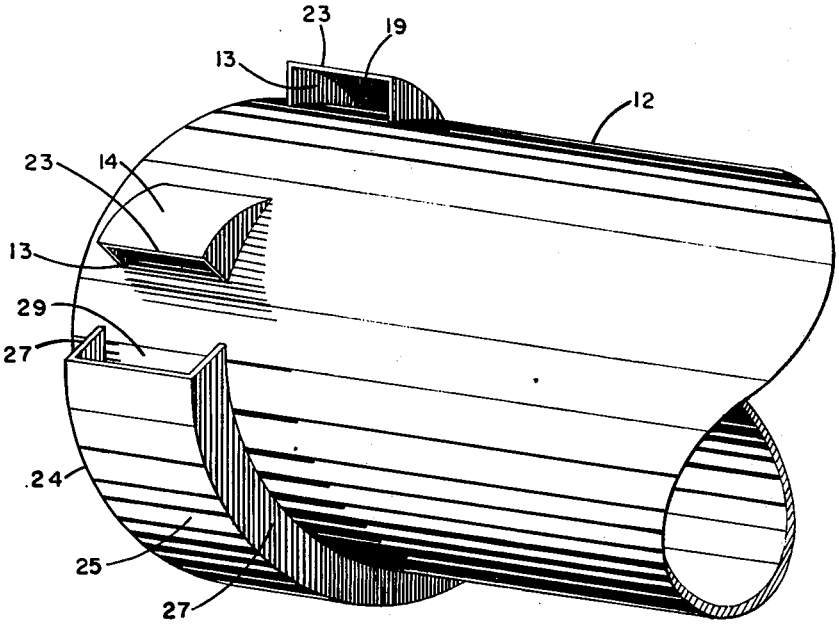
FIG. 2 is a perspective view showing the apparatus of FIG. 1.

Referring to FIGS. 1 and 2 there is shown the scoop feed embodiment for a cylindrical heating and mixing drum 12, preferably of the type disclosed in my aforesaid co-pending applications and patent. It will be noted by observing FIG. 5 that this scoop feed embodiment is provided at or adjacent the inlet or cold end of the apparatus into which composition is initially introduced and which composition is drawn gravitationally as it is gradually heated and mixed toward the opposite hot output end of the drum. As shown, six scoops four of which are designated 14, 16, 18 and 20 are spaced around the exterior of the drum 12 adjacent end plate 21. Each of the scoops protrude substantially from the exterior drum surface and are provided with openings 19 and an internal cavity 12. Interiorly of the scoops, a port 15 opens into the drum interior thereby providing an opening between the scoop cavity and the interior chamber of the drum. The lip or edge of the scoop provides a surface for engaging composition as the drum rotates and as will be more fully explained hereinafter.

In combination with the scoop is used a receptacle or other means for receiving composition and which receptacle is positioned adjacent the drum whereby the scoops will pass through the receptacle interior during drum rotation. A preferred type of such a receptacle comprises a trough 24 preferably having sides 27 and a bottom 25 forming a cavity into which the composition is fed. The size and shape of the trough should be such as to allow the scoops to pass therethrough and scoop or pick up composition which has been introduced into the trough cavity. The trough sides will preferably have edges which follow the general shape of the drum exterior around which they extend but which side edges are spaced at least slightly from the drum surface and avoid contact therewith since the drum rotates while the trough is maintained in a stationary position.

Means for introducing composition 31 into the trough is not especially critical and any convenient means may be used. For example, in FIG. 1, there is shown a hopper and chute member 22 which communicates with trough 24 and into which hopper composition is introduced utilizing a conveyor system 20. The composition 31 falls from the conveyor, through the chute and hopper gravitationally into trough 24. As drum 12 is rotated counterclockwise, observing FIGS. 1 and 2, the scoops will successively pass along the interior of trough 24 and composition will be forced into the scoop as lip 23 of each scoop engages the material. The size of the scoop opening is preferably sufficient to accommodate substantial amounts of composition as the scoop continues to pass through the trough. Thus, the edges of the scoop may form an opening only slightly smaller than the trough interior. For example, observing FIG. 1, scoop 18 shown in phantom is in a position whereby composition is forced gravitationally into the scoop as it continues to rise. Scoop 20 is in a position in which composition will have substantially emptied through port 15 into the drum interior.

The size and shape of both of the scoops and trough is not particularly critical. For example, the shape of the lips or edge of the scoops may be rounded or straight and preferably being the same as that of the interior trough cavity 29 but the latter being at least slightly enlarged so as to achieve maximum efficiency in introducing composition to the drum interior. The scoop walls are also preferably sloped as shown in order to provide a chute or passageway for directing composition to the port. For that purpose any convenient shape may be used The number of scoops and ports which they cover may also be varied depending on the size of the drum and the amount of material which is to be continually or intermittently intoduced into the drum for heating and mixing. It is also preferred that the scoops and ports are located on the drum adjacent end wall 21 rather than substantially forwardly thereof in order to utilize the maximum length of the drum in the heating and mixing process.

COMPOSITION RECOVERY PORTS

Figure 3:
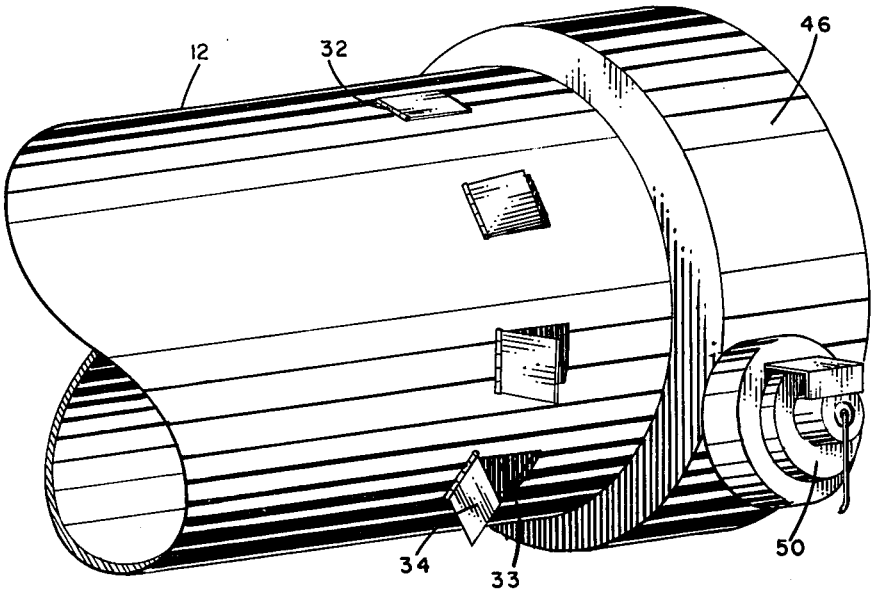
FIG. 3 is a perspective view of the forward end of the drum apparatus of the invention showing product removal ports.
Figure 4:
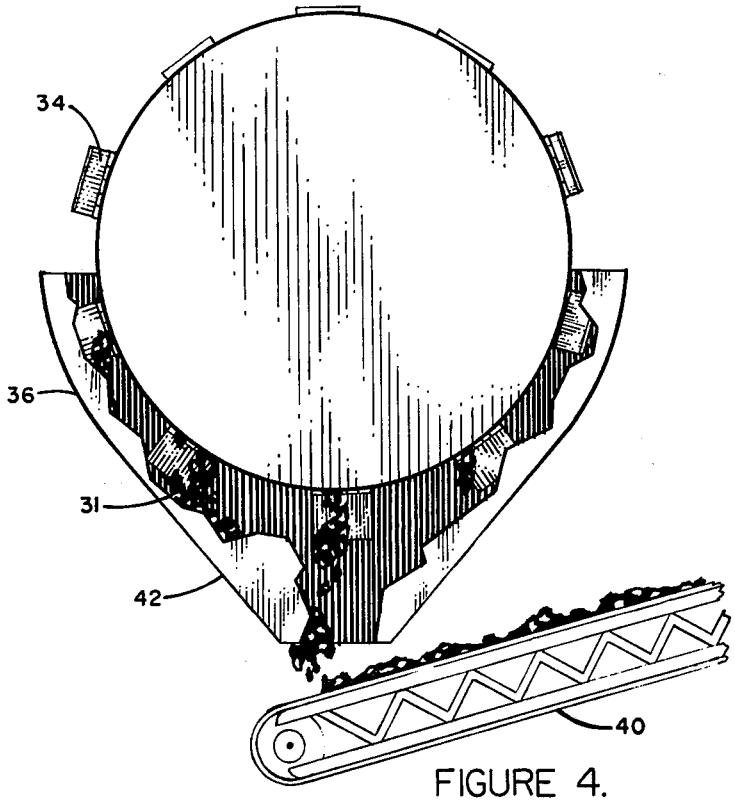
FIG. 4 is an end elevational view of the apparatus of FIG. 1 showing means for recovering composition from the apparatus.

In FIGS. 3 and 4 there is shown another embodiment of the invention in which a plurality of ports 33 are spaced around the exterior surface of the drum 12 adjacent the forward drum end opposite the input end previously described. These ports communicate with the drum interior so that composition which has been heated and mixed in the drum as it is drawn toward the forward drum end will pass through the ports gravitationally. The size and spacing of the ports is not particularly critical so long as product recovery is suitably achieved. Preferably the ports are located next to, near or adjacent the forward drum end so as to avoid a substantial space between the ports and the forward drum end wall in which space heated material would be held and could not be readily recovered without reversing the tilt of the drum or scooping it out by hand through the ports. In the preferred embodiment shown, each of the ports is provided with a cover 34 which is secured to a hinge 32 on which the covers pivot. These hinges are designed so that the covers can swing or pivot freely about the hinge axis. In this manner, as illustrated in FIGS. 3–4, as the drum rotates and the ports pass through the horizontal plane extending across the diameter of the drum at approximately its center the covers will begin to open gravitationally. As the drum continues its rotation, the covers in the lower arc or segment of the drum are substantially opened so as to allow product to fall through the ports.

This embodiment is preferably utilized in combination with a trough member 36 having a cavity therein for receiving the product composition as it falls through the ports. FIG. 4 also illustrates a chute 42 adjacent the trough and under which extends a conveyor belt 40 for recovery of the composition. The specific size of the trough is not particularly critical but it is preferably designed with sloping sides so that the product will readily be directed gravitationally for removal. As is also shown, the upper sides will also terminate adjacent the drum exterior wall and are spaced therefrom so as not to interfere with the drum rotation since the trough is held in a stationary position. Moreover, any means for removing the composition which has been received in the trough, such as the use of the chute 42 and conveyor apparatus 40. Similar and equivalent means for removing the composition will be understood by those skilled in the art.

The use of the hinged covers also provides for closing of the ports gravitationally as the drum rotates. As is illustrated in FIG. 4, the covers located in the upper arc or segment of the drum are in a closed position. This offers the advantage in that hydrocarbon gases, smoke and the like given off from the heated asphalt near the hot forward end will not be vented into the atmosphere through the closed ports. Of course, the covers may not be fully closed until they are at least somewhat above the center horizontal plane.

Figure 5:
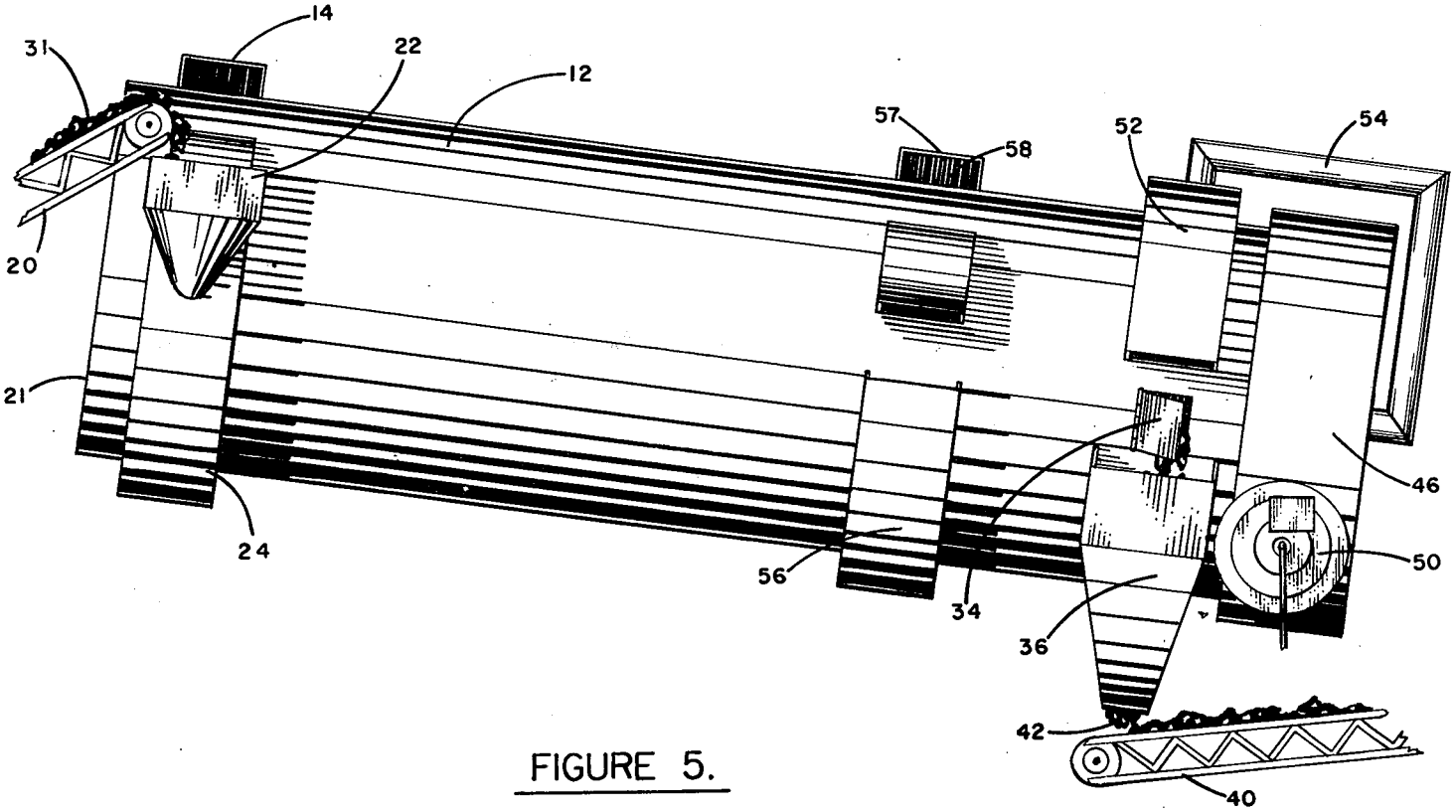
FIG. 5 is side view showing the embodiments of FIG. 1–4 and moisture exhaust ports.

FIG. 5 illustrates the use of an optional gas and vapor accumulator collar 52 that may be used where prevention of venting hydrocarbons into the atmosphere is important. The collar is hollow and extends around the upper drum exterior thereby covering the ports. One or both ends may meet the ends of trough 36 but a space between these ends along the side where product is first recovered through the ports is preferred for observation of the recovery process as illustrated. Moreover, a conduit or pipe 54 also communicates between the collar and the furnace 46 in which a burner 50 directs heat into the heating tubes. In this manner, the furnace heating chamber will cause a draft through the pipe to assist in pulling any gases from the collar to the furnace chamber. Moreover, it will be understood that composition passing through open ports in the lower portion of the drum will occlude the openings and further prevent significant venting of the vapors.

WATER VAPOR EXHAUST PORTS

Referring further to FIG. 5, there are shown a plurality of exhaust ports 58 which extend around the drum exterior and which ports communicate with the drum interior. These ports are spaced around the drum at a location or position of the drum length at which the composition is heated near the point at which the water vapor begins to vaporize in substantial amounts. Preferably, each of the ports is provided with a cover in the form of a scoop 57 of a design substantially like that referred to in the scoop feed embodiment previously described. Another stationary trough 56 extending around the lower drum segment or half, again, similar to the trough previously described in FIG. 2, is also used. The purpose for the trough and the scoop shaped covers is to collect and pick up any composition that passes through the exhaust ports gravitationally as the drum is rotated. For example, as the ports pass through the lower arc during drum rotation, some composition will fall through the ports, out of the scoops and into the trough and will then be scooped up from the trough by the scoop shaped covers as they pass through the trough cavity in a manner substantially as described previously regarding the scoop feed embodiment.

The proper positioning of the water vapor exhaust ports is important so that optimum or near optimum advantage of venting of the water vapor is achieved. Again, positioning of the ports will be readily determined by selecting the position along the length of the drum mixer and heater at which extensive moisture vaporization is realized. The asphalt-aggregate is heated from ambient temperature at the cool input end to at least about 225° F and preferably above about 300° F at the hot output end. Thus, usually, composition temperature of about 210°–215° F is achieved somewhere between about one-half and about two-thirds of the length of the drum from the cool end. FIG. 5 shows the ports in such a position. As previously noted, this exhausting or venting of water vapor will obviate the problem of repeated vaporization and condensation within the drum heating and mixing chamber and the concomitant disadvantages of poor heating efficiency and energy requirements. These as well as other advantages of the apparatus and methods described herein will be evident to those skilled in the art as will variations and modifications within the purview of the inventions.

I claim:

1. In an apparatus for heating and mixing asphalt-aggregate compositions comprising a rotatable elongated cylindrical drum having means at an input end for introducing said composition therein, means at the opposite output end for recovering said composition, a plurality of tubes extending through said drum for heating said composition, heating means at said opposite drum end for heating said composition gradually between said input end and said output end to a temperature above about 225° F, the improvement comprising at least one exhaust port along side drum intermediate said drum ends communicating with the drum interior at a location where said composition is heated to the boiling point of water.

2. The apparatus of claim 1 including a scoop attached to said drum exterior overlying each said exhaust port and a stationary trough adjacent said drum and extending around a lower portion of the exterior thereof and positioned to successively receive each said scoop therein as said drum is rotated.

3. An apparatus for mixing asphalt-aggregate composition comprising:

an elongated rotating cylindrical drum having an interior mixing chamber and a plurality of scoops extending around the drum exterior at one end which scoops each have a lip defining a scoop opening for receiving composition, a plurality of input ports along the drum exterior each communicating with the drum mixing chamber and one of said scoops for directing composition into said chamber, a stationary trough member adjacent said drum end extending around at least a portion of said drum exterior and having a trough cavity for receiving said composition and having a sectional shape substantially like the periphery of said scoop lips and slightly enlarged therefrom for successively receiving said scoops as said drum is rotated, a plurality of output ports spaced along the drum exterior and communicating between the interior and exterior of said drum and through which said composition is recovered, a combustion chamber for heating said drum, and a stationary collar member extending around at least a portion of said drum overlying said output ports and a conduit communicating between said collar and said combustion chamber whereby gases exhausted by said outer ports pass through said conduit and into said combustion chamber.

4. The apparatus of claim 3 including a plurality of tubes heated by said combustion chamber extending along said drum interior for heating composition within the drum.

5. The apparatus of claim 3 wherein said trough member has sides having an upper edge extending around at least a portion of said drum exterior and a bottom secured to said sides and wherein said sides and bottom define said trough cavity therebetween.

6. The apparatus of claim 3 including a cover associated with each of said output ports mounted adjacent thereto for movement between open and closed positions.

7. The drum of claim 6 wherein each of said covers is attached to a hinge and pivot thereon to alternately open and close said output ports as said drum is rotated.

8. A rotating drum for mixing asphalt-aggregate composition comprising an elongated rotatable drum, a plurality of output ports spaced along the drum exterior and communicating between the interior and exterior of said drum and through which said composition is recovered, a combustion chamber for heating the interior of said drum, and a stationary collar member extending around at least a portion of said drum overlying said output ports and a conduit communicating between said collar and said combustion chamber whereby gases exhausted by said output ports pass through said conduit and into said combustion chamber.

9. The drum of claim 8 including a cover associated with each of said output ports mounted adjacent thereto for movement between open and closed positions.

10. The drum of claim 9 wherein each of said covers is attached to a hinge and pivot thereon to alternately open and close said output ports as said drum is rotated.

11. The drum of claim 8 including a plurality of tubes heated by said combustion chamber extending along said drum interior for heating composition in said drum.

12. In an apparatus for heating and mixing asphalt-aggregate compositions comprising a rotatable elongated cylindrical drum having end plates at each end thereof, a plurality of heated tubes extending therethrough, and a combustion chamber for heating said tubes, the improvement comprising a plurality of first spaced ports adjacent one end thereof through the drum exterior surface and communicating with the interior thereof, a scoop secured on said drum exterior over each said port and having an opening communicating with said port, a stationary trough adjacent said drum and extending around a lower portion of the exterior thereof and positioned to successively receive said scoops as said drum is rotated, a plurality of second ports spaced along the drum exterior adjacent an end of said drum opposite said scoops and communicating interiorly of said drum, the drum being tilted from horizontal whereby said composition introduced in one drum end by said scoops is recovered at said opposite drum end through said second ports, a stationary collar member extending around at least a portion of said drum overlying said second ports and a conduit communicating between said collar and said combustion chamber whereby gases are exhausted from said second ports through said conduit and into said combustion chamber.

13. The apparatus of claim 12 including hinged covers mounted on said drum adjacent each of said second ports for alternately opening and closing said second ports as said drum is rotated.

* * * * *